United States Patent [19]

Oberley et al.

[11] 3,992,905

[45] Nov. 23, 1976

[54] COMPRESSION EXTRACTOR DEVICE FOR LAUNDRY GOODS

[75] Inventors: Gene Oberley, Westchester; Richard D. Thompson, Cincinnati, both of Ohio

[73] Assignee: McGraw-Edison Company, Elgin, Ill.

[22] Filed: June 30, 1975

[21] Appl. No.: 591,757

[52] U.S. Cl. ..... 68/241; 100/48; 100/49; 100/127; 100/215; 100/218; 100/223; 100/295

[51] Int. Cl.[2] ..... D06F 47/04; B30B 15/02

[58] Field of Search ..... 68/241, 21, 210; 34/14, 34/70, 236; 100/223, 126, 127, 128, 129, 215, 218, 48, 49, 295, 116, 174

[56] References Cited

UNITED STATES PATENTS

| | | | |
|---|---|---|---|
| 3,039,383 | 6/1962 | Windle et al. | 100/295 X |
| 3,522,768 | 8/1970 | Shann | 100/223 X |
| 3,844,142 | 10/1974 | Miller | 68/21 X |

FOREIGN PATENTS OR APPLICATIONS

| | | | |
|---|---|---|---|
| 1,065,826 | 4/1967 | United Kingdom | 100/223 |

*Primary Examiner*—Philip R. Coe
*Attorney, Agent, or Firm*—Charles F. Lind

[57] ABSTRACT

This invention teaches a compression extractor device for removing excess water from laundered goods. The device has one or more tubs, each having pervious sides and an open top and an open bottom, and frame structure that supports the tub(s) for movement relative to the frame between and to spaced load, extract, and unload operating stations. There is structure for registering and holding the tub(s) at the respective stations, particularly the extract station. There is frame clearance above the open tub top at the load station and frame clearance below the open tub bottom at the unload station, although a frame base plate underlies and closes the open tub bottom at and between the load station and the extract station. The wet goods are thus adapted to be loaded into the open tub top at the load station and the extracted goods are adapted to be ejected from the open tub bottom at the unload station. Plunger means are associated with each operating station, and each is adapted to be moved from above the open tub top into the tub and downwardly against the goods in the tub. This action compacts the wet goods into the tub at the load station, squeezes with great force the wet goods at the extract station to force excess water from the goods for escape out the pervious tub sides and onto the base plate, and ejects the extracted cake of goods at the unload station.

7 Claims, 25 Drawing Figures

FIG. 5
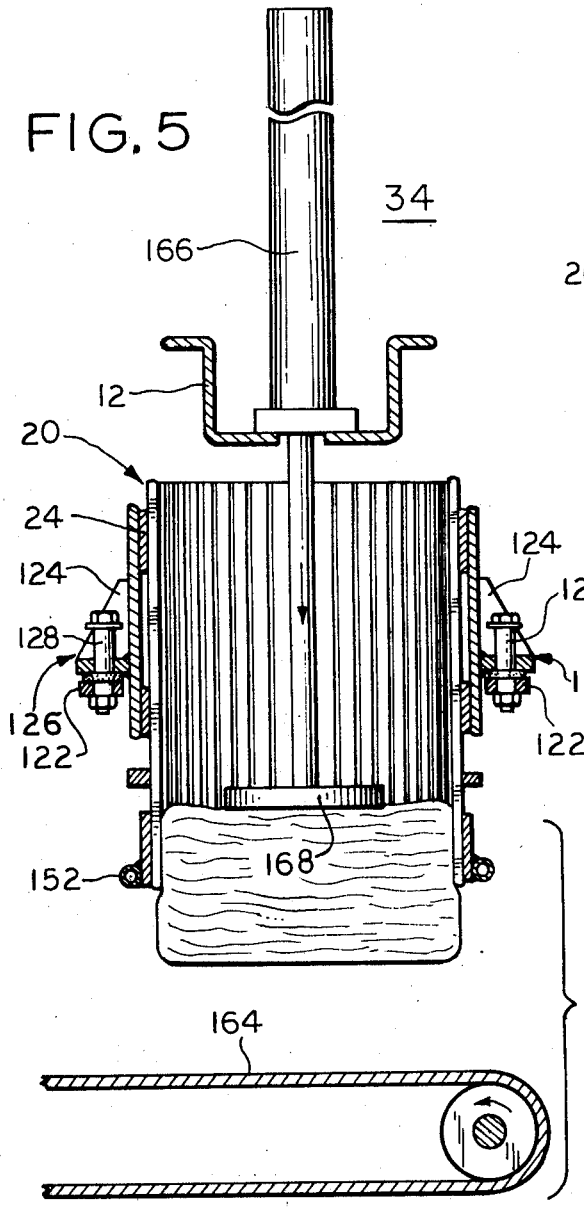
FIG. 7
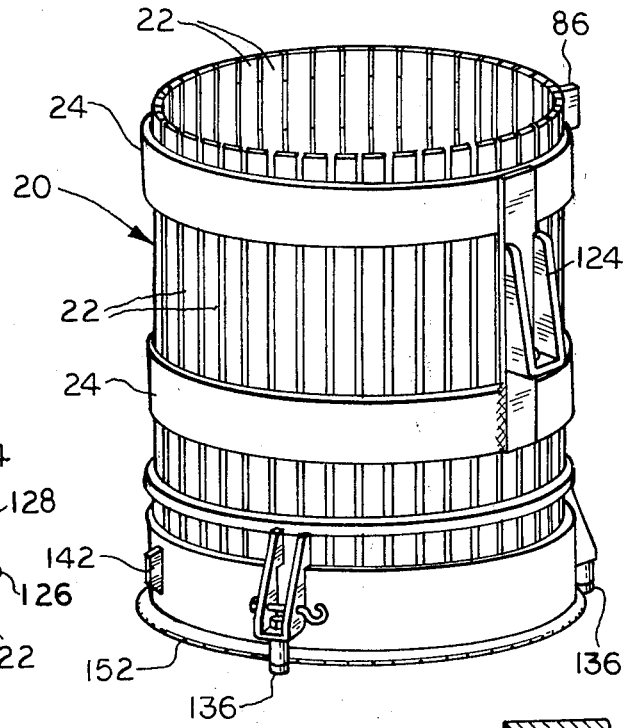
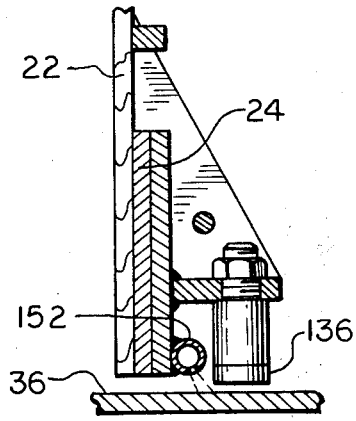
FIG. 9
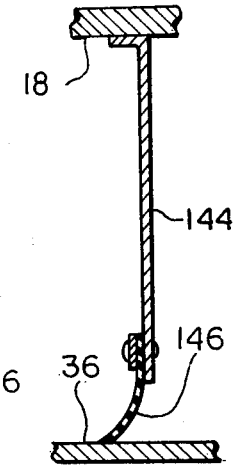
FIG. 10
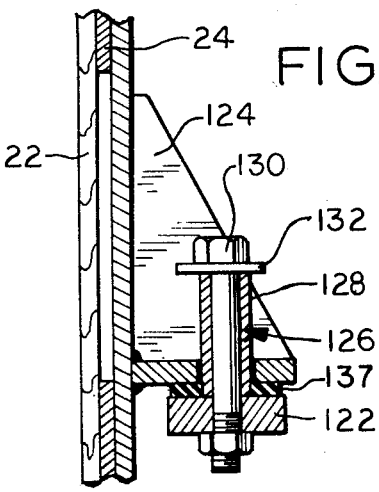
FIG. 8

FIG. 6
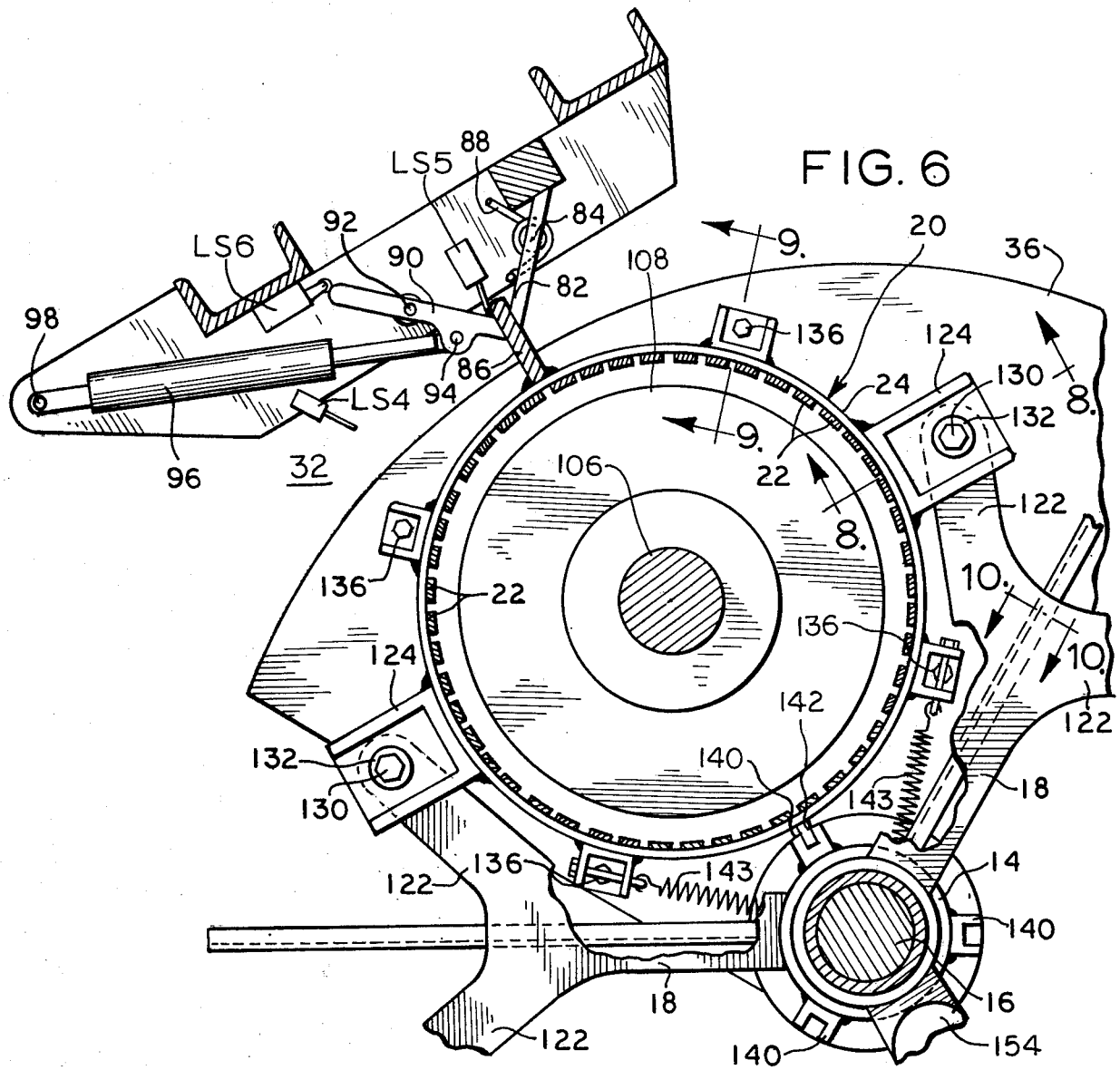
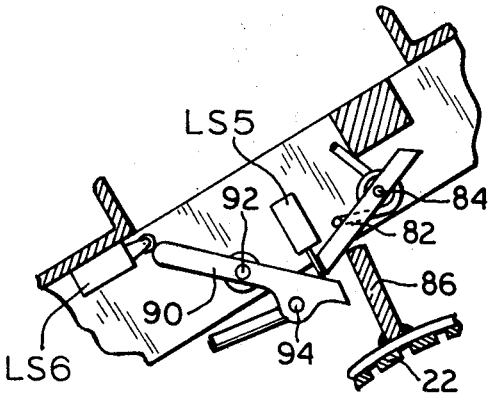
FIG. 6a
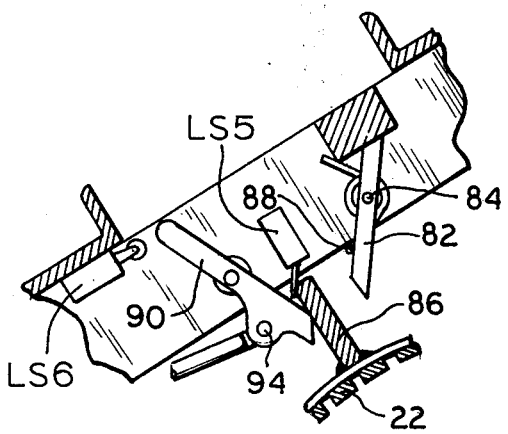
FIG. 6b

FIG. 11
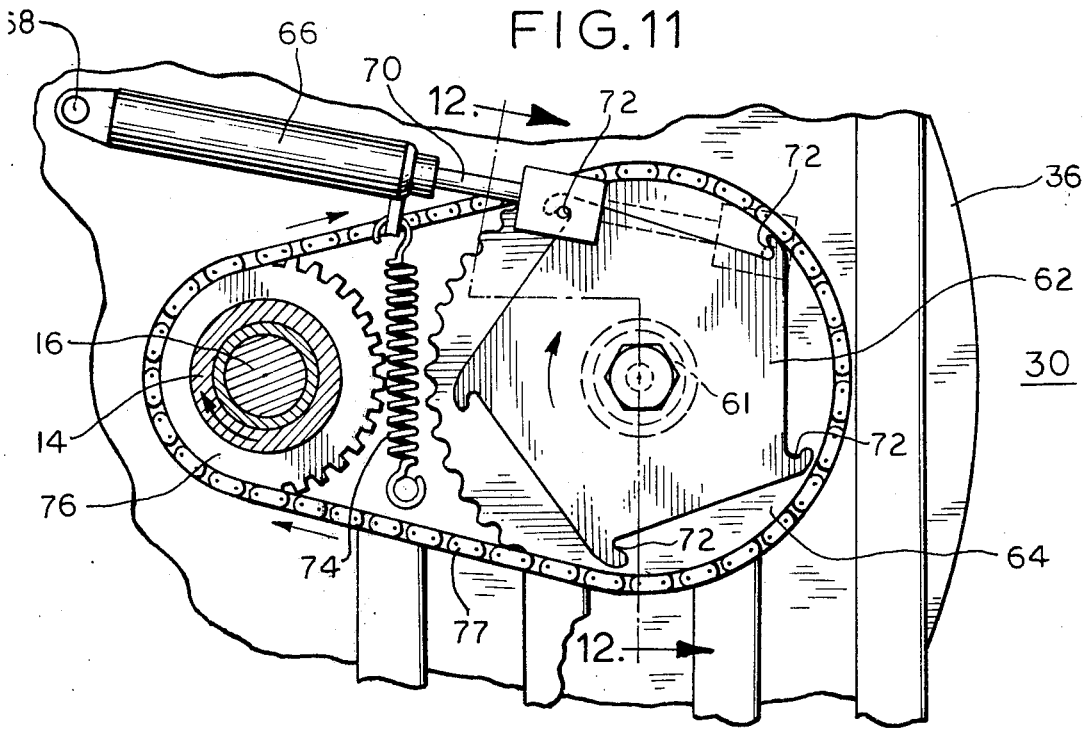
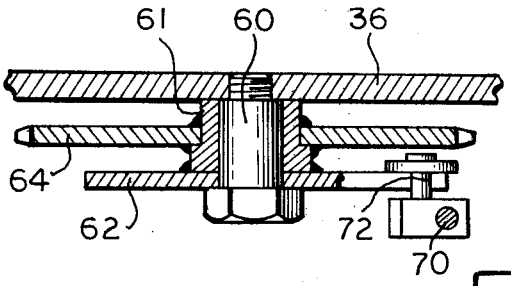
FIG. 12
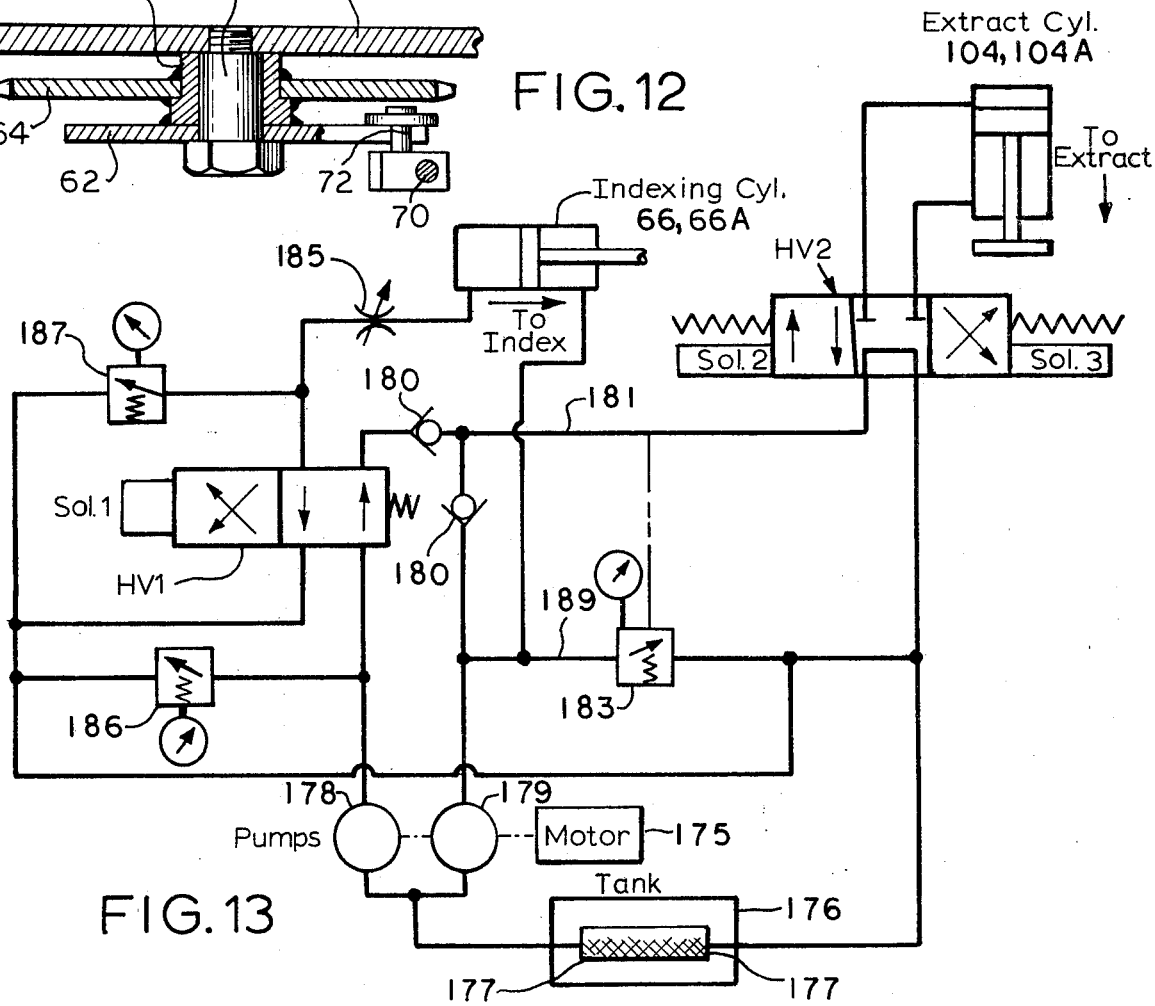
FIG. 13

FIG. 16
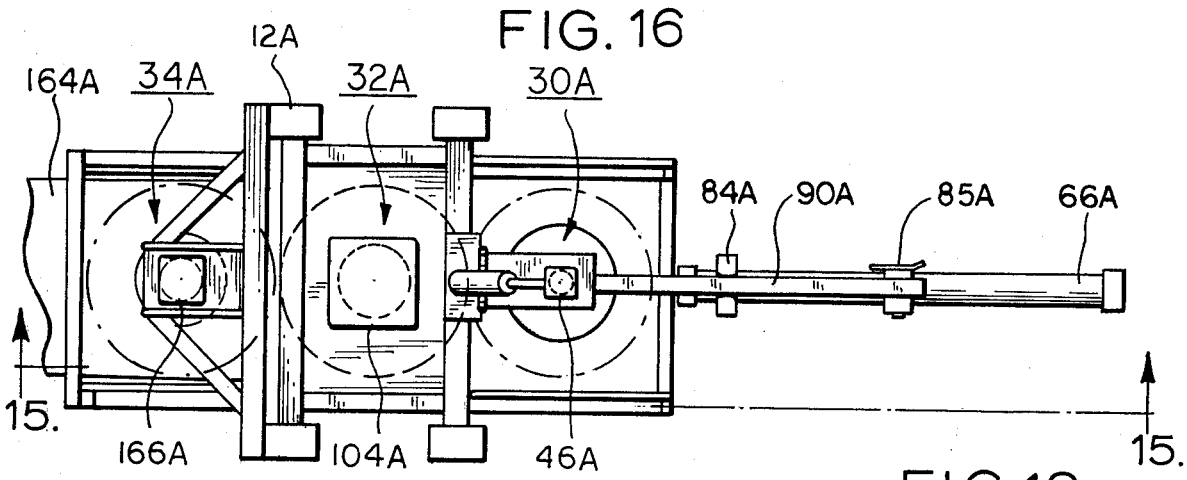
FIG. 18
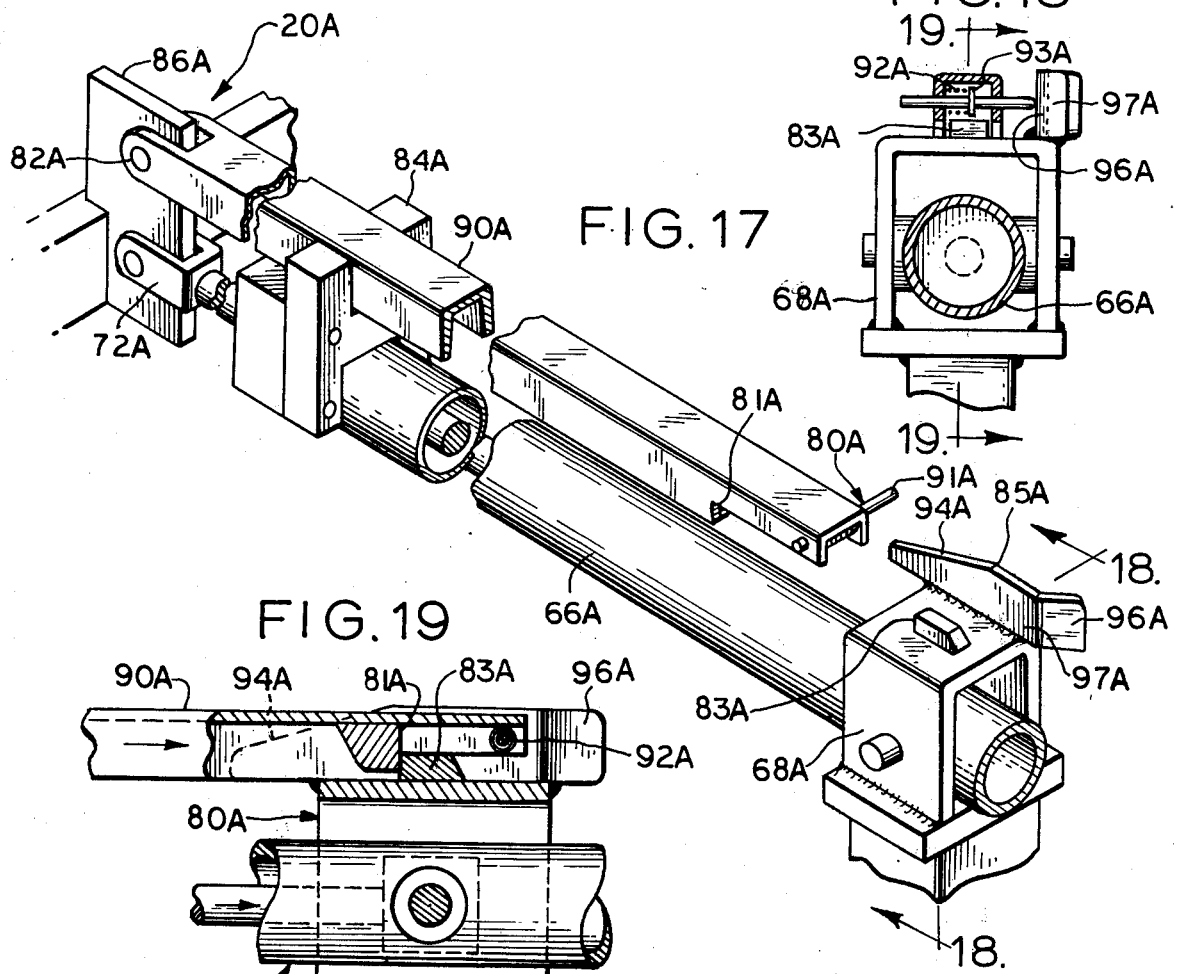
FIG. 17
FIG. 19
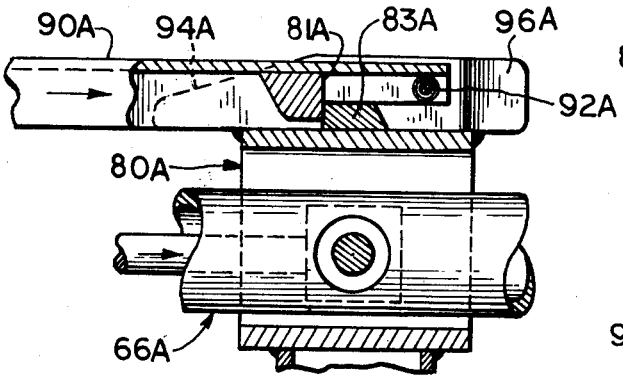
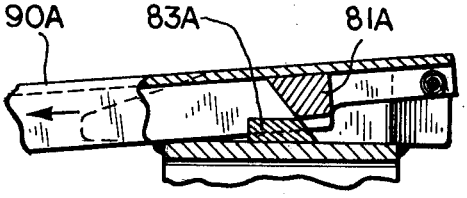
FIG. 19b
FIG. 19a
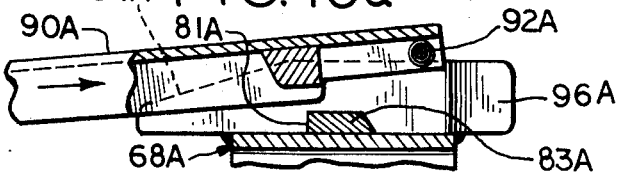

COMPRESSION EXTRACTOR DEVICE FOR LAUNDRY GOODS

BACKGROUND OF THE INVENTION

In commercial laundries, where the washing machines frequently have washing capacities in excess of several hundred pounds dry weight of laundry per wash, special extractor devices are used to remove excess water from the washed goods before drying the goods in a dryer. One form of extraction utilizes a pervious sided tub to hold the wet laundry goods and a plunger is then forced into the tub to compress the goods and squeeze the water therefrom for drainage from the tub. One conventional system mounts the tub on wheels, and the tub is filled at the washer and then rolled to the extractor device itself where the excess water is removed, and thereafter the tub with the extracted goods is rolled away for unloading at the dryer. However, with high production commercial washing systems utilizing banks of washers located side by side and automatic conveying means for otherwise transporting the soiled and/or washed goods, the big bottleneck thus far has been at the extractor.

SUMMARY OF THE INVENTION

This invention relates to a compression type extractor mechanism for removing excess water from laundered goods, and specifically is suited for use in commercial laundry establishments. The disclosed mechanism can be easily installed in existing or new laundry areas without costly preparatory structuring of the general local site, and further can be operated at high poundages per hour capacity on an almost automatic basis for both receiving the wet laundered goods and for discharging the extracted goods.

BRIEF DESCRIPTION OF THE DRAWINGS

FIGS. 3, 4, and 5 are views taken from lines 3—3, 4—4, and 5—5 in FIG. 2, respectively showing the loading station, the extract station, and the unloading station; and FIG. 4*a* is an enlarged view, partly in section and partly in schematic, showing details of a portion of the device illustrated in FIG. 4;

FIG. 6 is a top plan view showing a typical tub mounting arrangement used on the extractor device and specifically showing the tub cooperatively positioned at the extract station by turret locating mechanism; and FIGS. 6*a* and 6*b* are views of the turret locating mechanism of FIG. 6, except showing the same in different stages of operation;

FIG. 7 is a perspective view of a typical tub showing details of construction of same;

FIGS. 8, 9, and 10 are sectional views taken respectively from lines 8—8, 9—9, and 10—10 of FIG. 6;

FIG. 11 is a top plan view, partly broken away and shown in section, of the turret indexing mechanism as seen generally from line 11—11 in FIG. 3;

FIG. 12 is a sectional view as seen generally from line 12—12 in FIG. 11;

FIG. 13 is a schematic illustration of various hydraulic components used in the control for the units illustrated herein;

FIG. 16 is a top plan view of the device shown in FIG. 14, except showing the same on a reduced scale;

FIG. 17 is a perspective view, partly broken away and shown in section, of the tub indexing mechanism used in the device of FIGS. 14 - 16;

FIG. 18 is an end elevational view of the mechanism in FIG. 17, as seen generally from line 18—18;

FIG. 19 is an elevational view of the device in FIG. 18, as seen generally from line 19—19;

FIGS. 19*a* and 19*b* are views similar to FIG. 19 except showing the device in different stages of operation.

DETAILED DESCRIPTION OF THE INVENTION

First Embodiment: FIGS. 1 - 13

Figure 1:
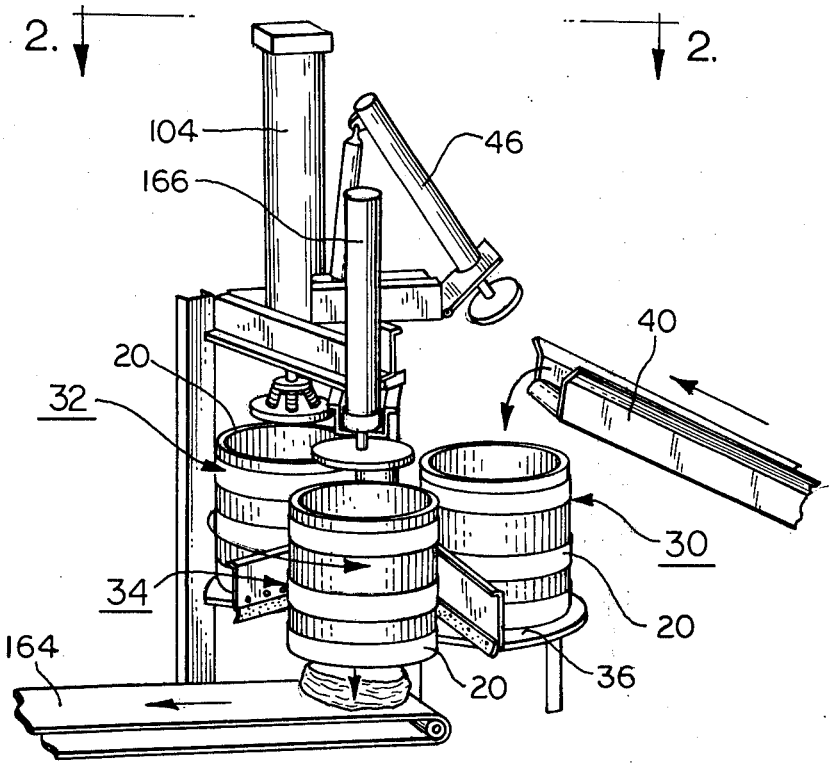
FIG. 1 is a perspective view of one embodiment of the subject extractor device showing it in operative cooperation with a wet goods infeed conveyor and with an extracted goods outfeed conveyor.
Figure 2:
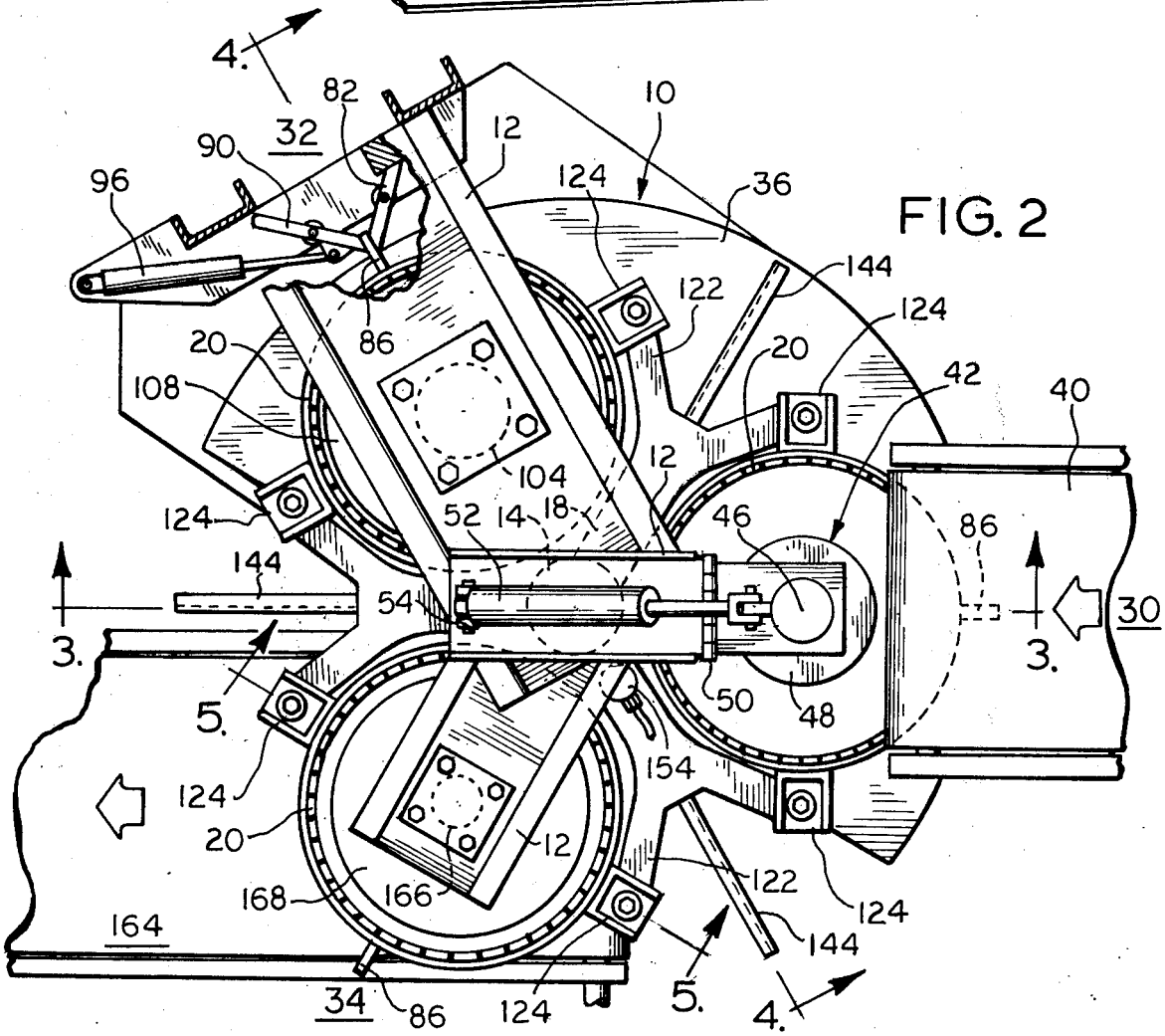
FIG. 2 is the top plan view of the extractor device shown in FIG. 1.

The extractor 10 disclosed includes a structural frame 12 and a turret 14 supported to rotate about main frame shaft 16, and the turret has three equally spread yoke arms 18 and a tub 20 is supported between adjacent yoke arms. Each tub (FIG. 7) has pervious side walls 22 which can be formed by separated slats held together by reinforcing bands 24, and has an open top and an open bottom. Indexing means 26 (FIG. 11) are used to rotate the turret 14 and the tubs 20 carried thereby in increments each approximately $\frac{1}{3}$ rotation or 120° so that each tub progressively is moved between three successive operating stations shown, respectively, as the loading station 30 in FIG. 3, the extract station 32 in FIG. 4, and the unloading station 34 in FIG. 5. The frame 12 includes a smooth base plate 36 which extends under the tubs 20 when the same are at and between the loading station 30 and the extract station 32, but no plate is beneath the tub at the unloading station 34.

Figure 3:
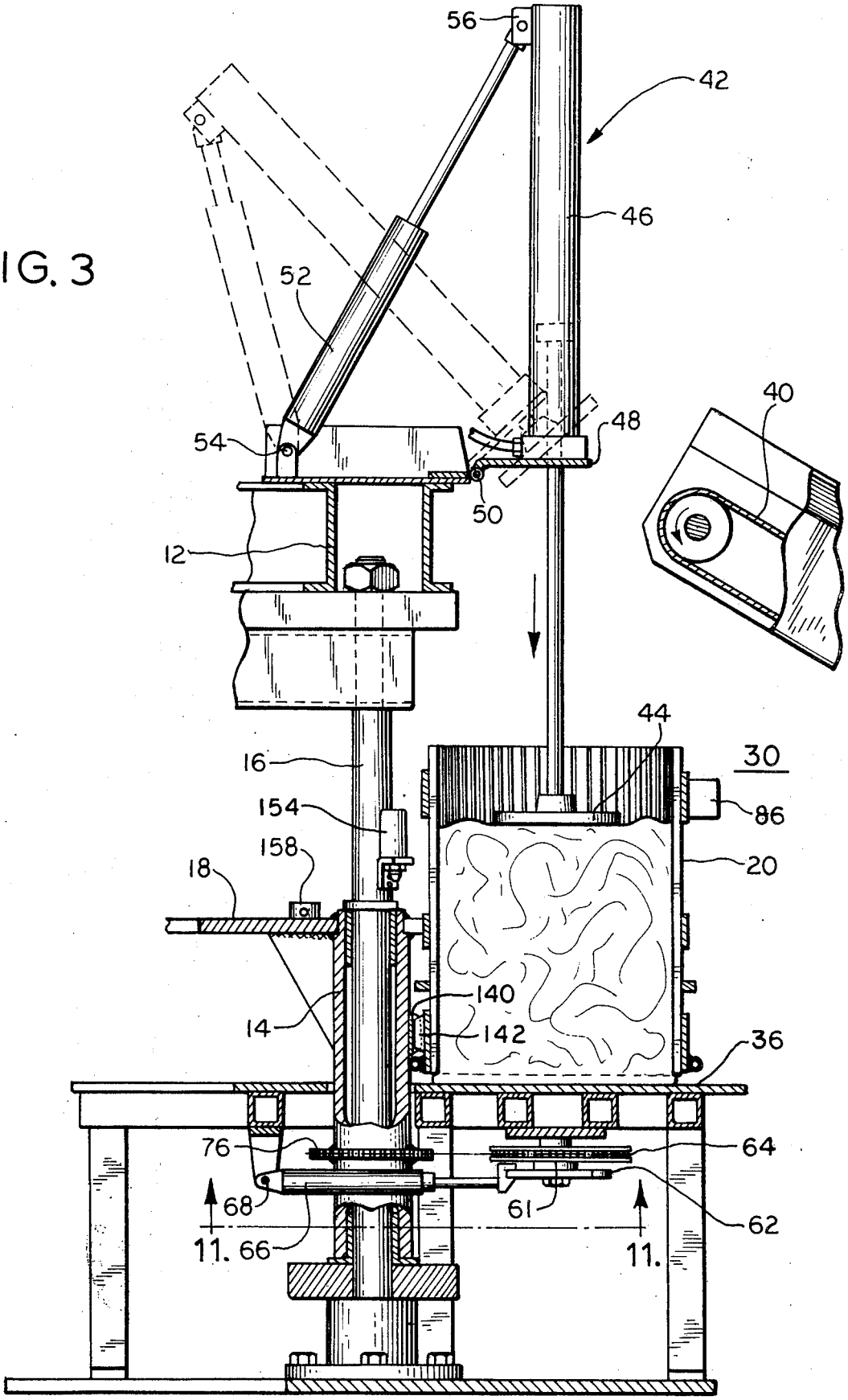
Figures 4, 4A:
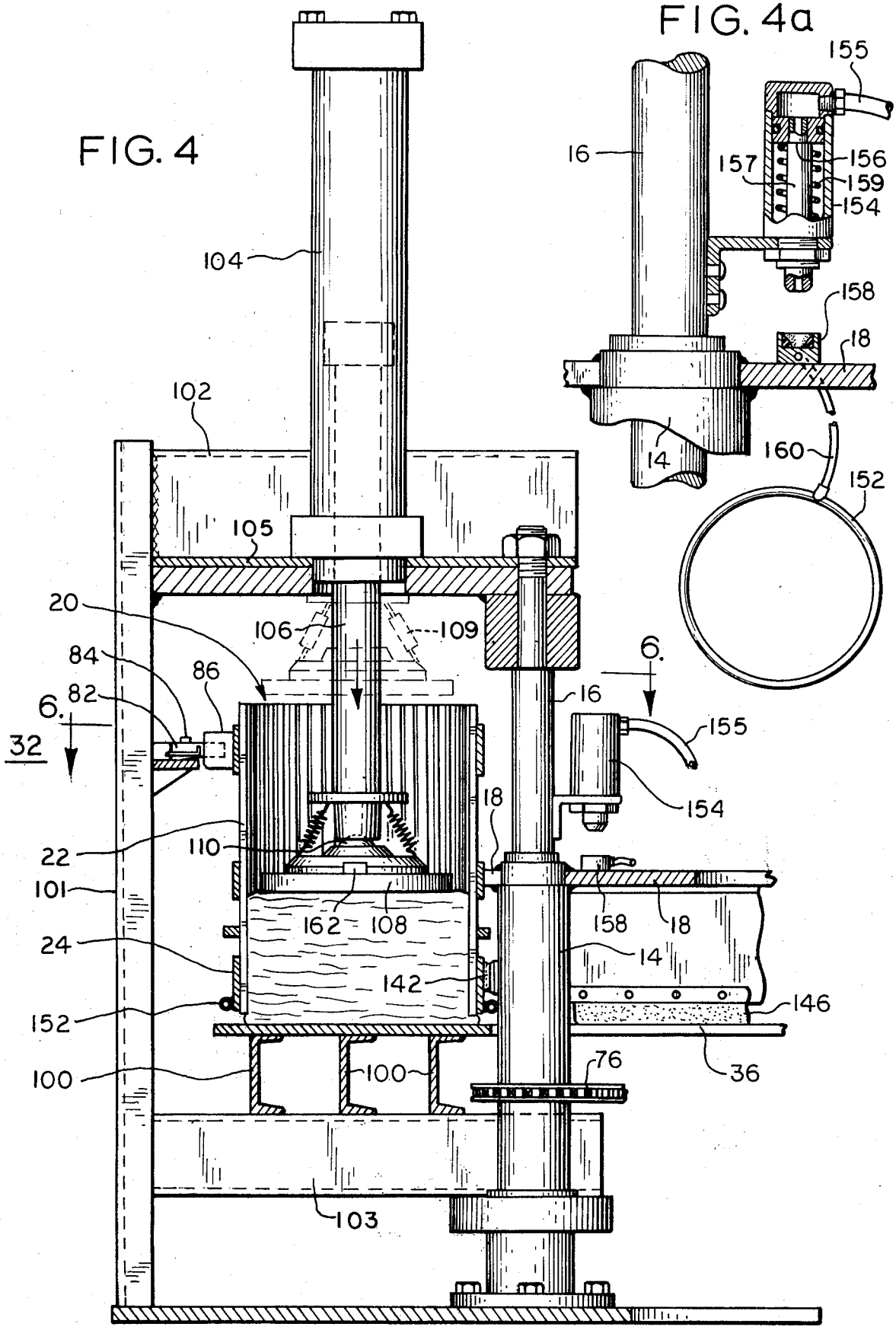
Figures 14, 15:
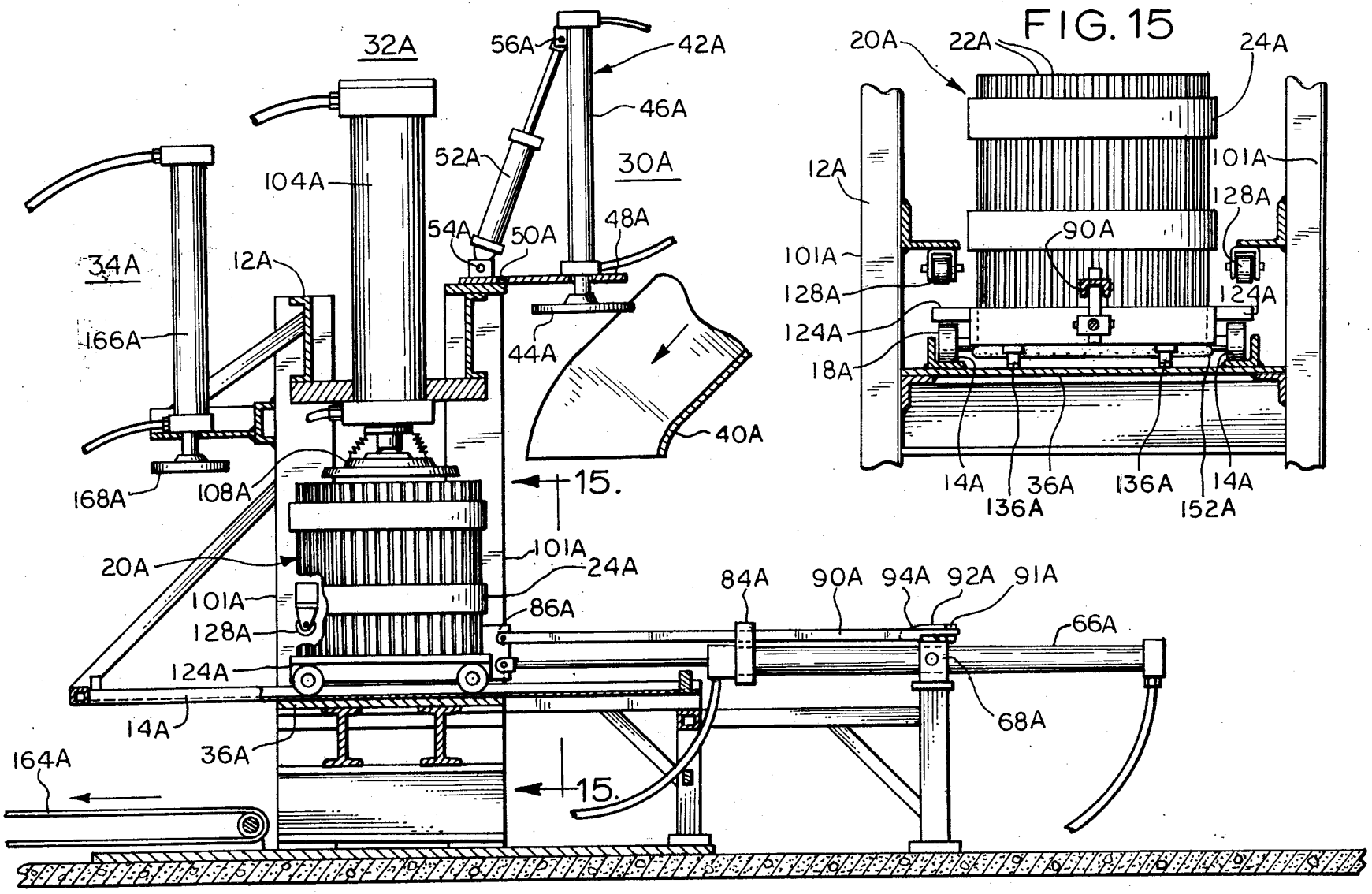
FIG. 14 is a side elevational view of a second embodiment of the subject extractor device, again showing it in operative cooperation with a wet goods infeed conveyor and with an extracted goods outfeed conveyor.
FIG. 15 is an end elevational view, as seen generally from line 15—15, of the device shown in FIG. 14.
Figure 20:
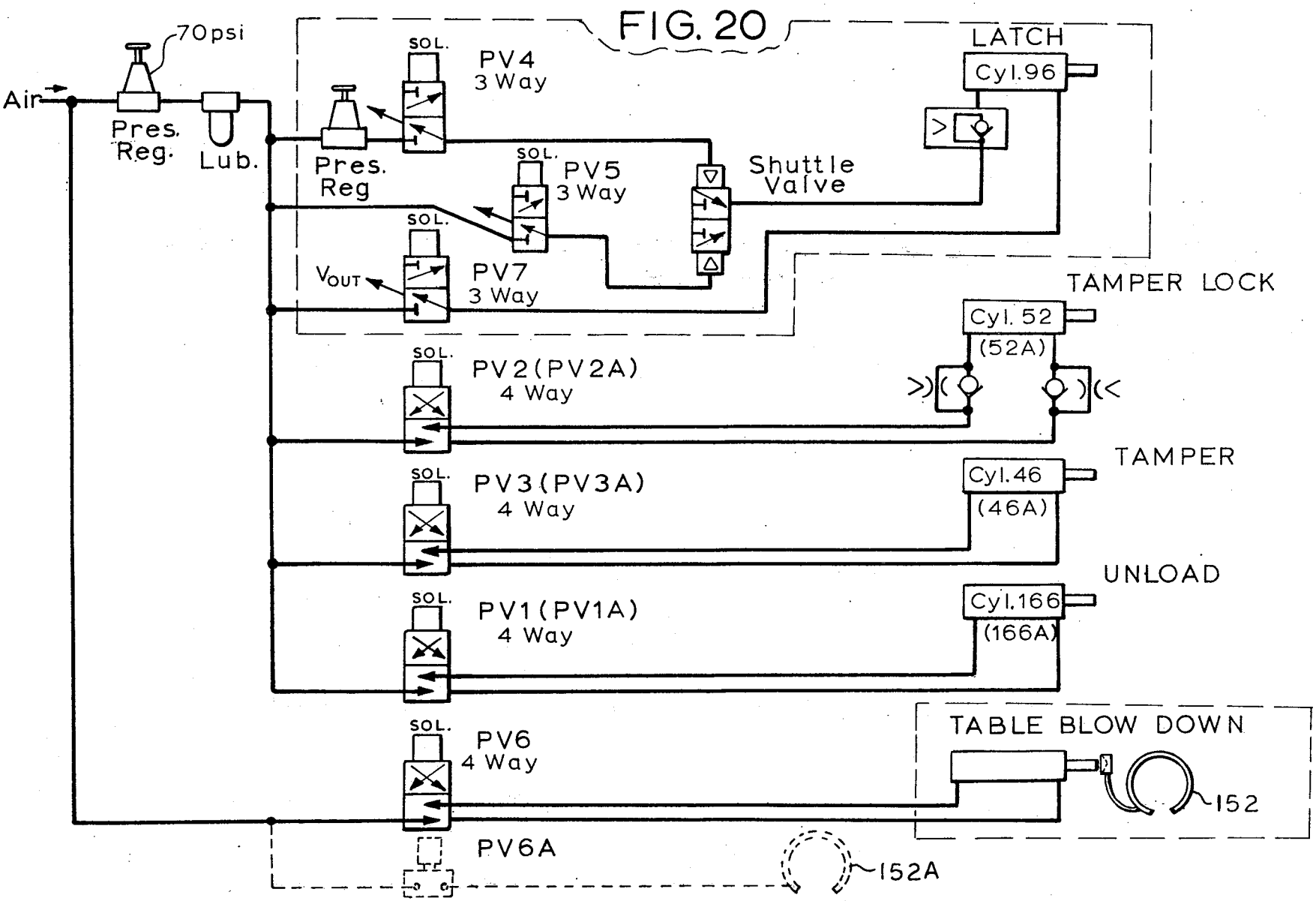
FIG. 20 is a schematic illustration of various pneumatic components used in the control for the units illustrated herein.

In typical use, a load of wet wash is loaded into the open top of the tub at the loading station, as shown in FIG. 3, by for example, a belt conveyor 40 which can be infed directly from the discharged end of a conveyor system from a bank of washers. By having the conveyor extend over the tub top, operation of the conveyor merely dumps the goods into the tub to stack up on the base plate 36 closing the tub bottom.

A tamping device 42 is used to pack the goods in the tub allowing a larger tub load for any one cycle, and this includes a plate 44 connected to the free rod end of a power cylinder assembly 46 which in turn is supported on a plate 48 hinged at pin 50 to the frame 12. Pressure applied to the power cylinder 46 thus urges the plate 44 down against the top of the goods and the tamping cylinder preferably is air operated utilizing pressures of for example, 50–100 psi with a timed packing stroke repeated at intervals automatically and further which is reversed to its upper highest extent automatically after a given sequence extended over a few minutes. This pushes all of the goods into the confines of the tub, thereby increasing capacity and also allowing minimum frame clearance above the tub without snagging any goods on tub movement between the load and extract stations.

Power cylinder 52 is connected at pin 54 to the frame and at yoke 56 to the upper end of power cylinder 46, and operates upon piston retraction to pivot the plate 48 and cylinder assembly 46 about the pin 50. With the cylinder 46 retracted and swung upwardly as shown in phantom, the positioned plate 44 serves as a backstop of goods coming off the conveyor 40; while the fact that the entire tamping device 42 is removable from direct overlying relation to the open tub at the loading station allows for alternate loading of the tub, such as from a chute, sling, or even manually.

As noted, the turret 14 is indexed to advance each tub into registry with the next station, and a preferred turret indexing means 26 is shown in FIGS. 3, 11, and 12. A shaft 60 is secured to the frame base plate 36 generally under the loading station 30 and a hub 61 is mounted to rotate about the shaft, and a pawl 62 and a sprocket 64 each is welded to the hub in coaxial relation to rotate as a single unit thereon. A power cylinder 66 is supported at pin 68 to the frame 12 and a roller assembly 70 is secured to the free rod end which engages and rides along the pawl edge and fits against and is adapted to be restrained by each respective pawl tooth 72. A spring 74 connected between the frame and the cylinder maintains the roller assembly in snug contact against the pawl edge. A sprocket 76 is secured to the turret 14, and a chain 77 is trained over the sprockets 64 and 76.

The pawl sprocket 64 is larger by a ratio of 5:3 than the turret sprocket 76, and the pawl 62 shown has five teeth 72; so that, extension of the cylinder means 66 and rotation of the pawl sprocket through only approximately 74° rotates the turret through an angle slightly more than 120° to thereby advance each tub to the successive operating stations. Preferably the actuating cylinder 66 is of a hydraulic type operating at a high pressure to produce the required large torque to move the turret while yet remaining within a reasonable size. For example, the cylinder could have a 3 inches diameter bore with a 15 inches stroke and operate at pressures up to 500 psi. The hydraulic cylinder further offers better control characteristics for indexing the turret as compared to a pneumatic cylinder. The contracting stroke of the power cylinder brings the roller 70 over the cammed backside of the next trailing pawl tooth to register with that tooth readying the device for the next indexing cycle.

In order to have proper alignment of the tub at the extract station 32, a combination shock absorber and lock device 80 is used. This device includes a positioning latch 82 which is pivoted about a pin 84 relative to the frame, where one latch end projects beyond tub flange 86 to interfere with the same and the opposite latch end abuts the frame. A spring 88 normally holds the latch 82 in the interfering position although the latch can be rotated in a clockwise direction (as shown) about the pin by the advancing flange 86 upon indexing the turret.

The index of the turret is sufficient to move the tub flange 86 completely past the latch and also causes the forward side of the flange 86 to engage locking latch 90. The latch 90 is pivoted at pin 92 to the frame and further is connected by pin 94 to the free rod end of a power cylinder 96 connected at its opposite end to the frame at pin 98. The latch 90 can be pivoted about the pin 92 between the locking position shown in FIG. 6 holding the drum flange 86 against the positioning latch 82 where the power cylinder 96 is extended, and a turret indexing non-interfering position where the power cylinder is retracted.

Upon indexing the turret initially, the power cylinder 96 is retracted to the non-interfering position of latch 90. In the initial phase of indexing, the tub at the extract station is shifted past a whisker switch LS4 (FIG. 6) which then serves to extend power cylinder 96 under moderate pressure. Continued tub indexing causes the next tub flange to pass latch 82 and to engage and shift the latch 90, which compresses the power cylinder 96 slightly (FIG. 6*b*) and serves as a shock absorber, in effect, in stopping the turret advance. This also shifts a limit switch LS5 (FIG. 6*b*) which serves to exhaust the turret indexing cylinder 66 and to apply additional pressure to the locking cylinder 96. This reverse turns the turret against the latch 82 and firmly holds the tub 20 in registry with the extract station; and also provides proper registry of the other tubs at the loading and the unloading stations. After the operating cycle the turret locking cylinder 96 and latch 92 are retracted to the non-interfering position to allow the next tub indexing.

At the extract station, the base plate 36 is reinforced by steel member 100, and likewise the frame 12 includes two steel columns 101 and the single round main frame shaft 16 that together extend between and support main frame components 102 and 103 below the base plate structure and above the tub. A structural web 105 supports in turn a large ram or power cylinder assembly 104 in vertical centered registry with the tub positioned at this extract station. The ram assembly 104 has a rod 106 which moves vertically in exact centered alignment relative to the positioned tub and a large plunger plate 108 is secured to the lower rod end. Preferably the plate has a spherical ball face 110 which cooperates with a complementary spherical socket on the rod 106 and springs 109 are connected between the plunger plate 108 and the lower rod end to hold the plate firmly against the rod while yet accomodating plate swiveling relative to the rod.

The plunger plate 108 is designed to fit closely within the tub with maybe only ¼ inch to ½ inch clearance on the sides and typically might be 32 ¼ inch in diameter to fit within a 33 inches inside diameter tub. A preferable tub height is of the order of 36 inches and the operating piston stroke is designed to be almost the full tub height or approximately 36 inches so that the plate 108 transverses most of the inside height of the tub and yet can be elevated sufficiently above the tub to allow tub indexing therebeneath. The ram is quite large, having a 12 inches or 14 inches bore and a 5 inches or 6 inches rod, and preferably operated by hydraulic means at pressures up to 1,800 psi. This exerts great compressive force against the wet goods in the tub to compact the goods to a cake between 5 inches to 10 inches thick, and the water drains out of the tub through the slatted open sides.

Withdrawal of the plunger allows the cake of extracted goods to expand from the 5 inches to 10 inches height as noted to 15 inches or 20 inches high. It is with interest that this expansion tends to be both upwardly relative to the tub from the lowest plunger lever and downwardly below the lower open tub end, so that in effect a large force is exerted between the goods and the base plate tending to lift the tub off the base plate.

Special mounting means for the tub to eliminate the problem and to accommodate vertical tub movement will now be disclosed.

Each turret arm 18 has two yoke arms 122, and each tub fits between adjacent yoke arms of adjacent turret arms. A pair of opposed slide connections 126 (FIG. 5 for example) is provided between each arm and the adjacent tub sides to allow for vertical tub movement relative to the turret. Specifically, each connection 126 includes a sleeve 128 held by a bolt 130 to the arm, and a tub bracket 124 having a slightly larger opening fits freely over the sleeve to slide relative thereto. A washer 132 confined between the upper sleeve end and the bolt head limits the upward tub movement relative to the yoke arm; whereas the downward tub movement is not limited by the yoke-bracket abutment, but is provided by four brass tub feed 136 (FIG. 9) equally spaced about the lower tub edge which abut the base plate 36. Spacers 137 of rubber are located between the tub brackets 124 and yoke arms 122 to elevate the tub feed off of the base plate when no plunger load is applied to the tub during turret indexing. A slide plate 140 is also secured to the turret (FIG. 6) opposite the lower tub end and spaced guides 142 on the tub cooperate with the slide to stabilize tub alignment while yet accommodating tub movement relative to the turret. Tension springs 143 between the tub and turret normally maintain the slides 140 and guides 142 tightly abutted.

A turret partition 144 extends between each of the tubs 20, and the lower partition edge has secured thereat a rubber squeegee element 146 which engages the base plate. This precludes water transfer between adjacent tubs when the same are located over the base plate and moreover sweeps any standing water off the base plate as the tubs are indexed. In this regard, the water is squeezed from the wet goods onto the base plate, so that by surrounding the entire extractor unit with a water retention curb and by providing a floor drain from this area, all extracted water can be easily carried away to a sewer or the like.

To further eliminate standing water on the base plate 36 there is provided at each lower tub end a circumferential blowoff tube 152 having fine openings for discharging air at high velocity against the base plate to blow the water radially from the tub. An automatic connector 154 is provided between a source of air at line 155 fixed relative to the frame column and the different air tubes on each of the indexing tubs. The connection takes the form of a power cylinder connected to line 155, where the cylinder piston 156 and connected rod 157 are hollow, to communicate thereby cylinder air through hollow rod. The extended rod is adapted to seat against a receiver 158 supported on the tub which in turn is connected by hose 160 to the air tube 152. Delivery of air to the air cylinder moves the piston against the force of light return spring 159 to a position where the rod seats on the receiver, and cylinder air automatically then is communicated to the air tube 152 on the respective tub. In this manner, only one air cylinder need be provided and the rod thereof cooperates with different receivers on the individual tubs automatically to provide the source of water blowoff air.

The pressure plate 108 preferably has formed on its face a series of grooves, each having a relatively sharp interior corner to prevent packing of the extracted goods in the groove, and this maintains open lateral channels for water flow to outside the confines of the pressure plate for more complete extraction.

As above noted, the force of the extract plunger is quite high, upward of several tons applied load. To prevent plunger rod damage should excessive misalignment occur it is preferably to locate a level switch 162 on the plunger to sense such misalignment and to automatically terminate plunger power responsive to this signal. This level switch 162 could be in the form of a mercury switch and the degree of tolerable swivel might be limited to 10° from the true horizontal. Preferably the extract stroke is timed, and a limit switch is used to detect that the plunger is fully retracted after the extract stroke.

After the goods have been extracted and the plunger withdrawn as above noted, the turret 14 is advanced to bring the extracted goods to the unload or eject station 32. The base plate 36 does not extend beneath this eject station so that the caked goods can be discharged from the open tub bottom. A power cylinder 166 (FIG. 5) is secured on the frame 12 in registry with the tub at the eject station and the free rod end supports a pressure plate 168 which descends onto the top of the cake and pushes the same from the tub. Typically a takeaway conveyor 164 is located below the tub at this station to receive the caked goods as the same are discharged. A timer can automatically reverse the cylinder to retract the same out of the way of the tub to allow the next turret indexing, and a limit switch likewise can be used to sense the plunger is in the fully retracted position.

The disclosed extractor unit can be easily utilized in a typical existing commercial laundry with little structural modification required from that ordinarily found in such establishments, or can be installed economically in a newly constructed commercial laundry. The frame is located entirely above ground and need only be bolted to the support floor for stabilizing the unit in normal operation. The various operating stations are supported entirely from and by the frame and thus do not require additional installing fabrication to make the unit operate. The unit can be surrounded by a water retaining curb to drain all water to a sewer located within the curbed area; and this typically is or can be easily provided in a commercial laundry, new or old.

The unit is particularly effective, in that gravity is utilized in part for both loading and unloading the tub, and this is achieved because of the open top, open bottom tub construction and pass through method of using the tub. The wet goods can be tamped in place at the load station for improving unit efficiency or output, and likewise the eject power cylinder removes the extracted goods effortlessly from the tub for further processing. The use of three separate stations for the loading, extracting, and unloading phases of the extract cycle is important also because auxiliary loading and/or unloading systems, for example, can be located by the respective station for improved operating and efficiency.

Second Embodiment: FIGS. 14 – 20

The extractor device 10A disclosed herein operates in a manner almost identical to the multiple tub device 10 disclosed initially, but it is intended as a lower cost, lower capacity unit. The device 10A utilizes only a single tub 20A which is supported by rollers 18A to ride along a pair of parallel tracks 14A between the three operating stations including specifically the load station 30A, the extract station 32A, and the eject station 34A. An indexing device 26A connected between the frame and the tub effects such tub movement. The frame 12A likewise has a smooth base plate 36A which extends under the tub 20A when it is at and between the load station 30A and the extract station 32A, but there is no base plate beneath the tub at the unload station 34A.

Note that components used in this embodiment are numbered the same as similar components were numbered in the first embodiment, except for the addition of the suffix A.

The device further has located at the load station 30A a tamping cylinder 46A with its associated plunger plate 44A, and the tamping cylinder again is mounted on plate 48A shifted by cylinder 52A. This tamping device operates in virtually an identical manner as that disclosed already for the primary multiple tub embodiment.

There likewise is provided at the extract station 32A an extract ram 104A which operates a pressure plate 108A. This plunger operates to squeeze goods in the tub when the same is positioned at the extract station, and the extracted water merely flows out the tub 20A past the tub slats 22A and onto the base plate 36A and/or onto the ground support for the extractor.

There likewise is provided at the unload station 34A an unload or eject cylinder 166A which controls plunger 168A, and the extracted goods are typically ejected out the open tub bottom onto a take away conveyor 164A.

The tub 20A, as noted, is carried on the rollers 18A along the parallel tracks 14A. The tub indexing device 26A operates by means of a power cylinder 66A connected intermediate its ends by a yoke 68A relative to the frame 12A and having its rod connected by a yoke device 72A to the tub at flange 86A. Full retraction of the power cylinder positions and holds the tub at the load station 30A and full extension of the power cylinder positions and holds the tub at the unload station 34A. Consequently, the cylinder has a reasonably long stroke which extends across the distance of at least two tub diameters. The cylinder further has a bore of approximately 3 inches and operates at pressures up to approximately 500 psi and preferably is hydraulic for smooth indexing of the tub between the various stations. The tub as positioned at the load station 30A and at the eject station 34A preferably is centered relative to the particular cylinder arrangement 46A or 166A at these stations, although such is not really that critical.

The centering and locking of the tub is most critical at the extract station 32A and the structure for and manner of doing this will now be disclosed.

There is overlying the cylinder 66A a tub locking device 80A which includes an elongated bar or latch 90A (FIG. 17) pivoted at a yoke configuration to tub flange 86A by pin 82A. Guide 84A secured to the power cylinder 66A presents side legs which straddle the latch bar 90A and allow the bar to slide freely relative to the cylinder when the power cylinder is extended and retracted, while maintaining the bar in parallel orientation over the cylinder. The latch 90A has a shoulder 81A which cooperates with a stop 83A on the cylinder mounting structure 68A precisely when the tub is centered at the extract station 32A, and this precludes tub movement in the direction toward the load station 30A.

In use, the power cylinder 66A is extended from its completely retracted condition to move the tub from the load station toward and slightly beyond the extract station until the latch bar shoulder 81A clears the stop 83A and the bar drops slightly to open a limit switch LS5A. This causes control valve for cylinder 66A to be shifted which thereby retracts the cylinder, but the return movement of the tub continues only until the latch shoulder 81A and stop 83A abut. The cylinder remains under pressure then to hold the tub at this position which, as noted, is precisely at the extract station.

After the goods in the tub have been extracted and the power plunger 108A removed upwardly above the tub, the goods again expand from the very compact cake both upwardly within the tub and downwardly beyond the tub bottom. A pair of rollers 128A (FIG. 15) supported on frame columns 101A in overlying relationship to spaced rails 124A formed as part of the tub assembly engage the rails and preclude continued lifting of the tub beyond this. The rails 124A extended approximately the width of the tub to allow extension of the power cylinder 66A and the tub movement from the extract station toward the unload station. Since there is no base plate 36A underlying the tub at the unload station, eventually the tub will again be supported by the rollers 18A engaging tracks 14A, particularly when the tub is centered at the unload station 34A.

After the goods have been unloaded from the tub at the unload station by the eject cylinder 166A, the tub is moved from the unload station back to the load station by the retracting action of the power cylinder 66A. In order to render the tub locking device 80A ineffectively on this return movement of the tub past the extract station, the following structure is provided. The latch bar 90A has a plunger 91A supported in spaced openings in the latch bar 90A whereby the plunger can reciprocate crosswise of the bar. A spring 92A positioned on the plunger between the latch bar and a shoulder 93A secured on the plunger normally biases the plunger to its extended position. A cam 85A is formed on the yoke assembly 66A and has a cam face 94A which engages the extended plunger and lifts the plunger and the entire latch bar 90A sufficiently so that the latch shoulder 81A clears the stop 83A on the return movement of the tub between the unload station and the load station.

In order to neutralize this disengagement effect of the latch in movement of the tub before extraction from the load station to and slightly beyond the extract station, the cam 85A also has additional cam faces 96 and 97 which engage and axially displace the plunger when the latch bar 90A is supported on its yoke guide and the plunger passes this cam structure. Consequently, the latch bar is independent of the cam face 94A during the initial positioning of the tub at the extract station prior to the extraction phase of the cycle, which thus allows for the tub locating engagement of the latch bar shoulder 81A and frame stop 83A.

OPERATION AND CONTROL OF THE SUBJECT EXTRACTORS

In the preferred hydraulic system (FIG. 13) a motor 175 powers a double pump having inlets from a tank or reservoir 176 through a strainer 177 to provide two outlets, one from a pump 178 operating at a moderate volume and high pressure and the second from a pump 179 operating at a high volume and moderate pressure. In this arrangement, the outputs of each pump pass through check valves 180 to provide only one-way flow in the circuit at line 181 and through oil control valve HV2 that connects with the extract cylinder 104 (104A).

The oil control valve HV2 preferably is a directional four-way valve with three set positions, having two positions for extending and retracting the extract cylinder respectively, and having a third position (as shown) for merely bypassing through the valve the infeed oil from the pumps back to the oil reservoir 176. There further is a dump valve 183 for bypassing flow from the output of the high volume pump 179 to the reservoir, and the dump valve is opened by a pressure connection off of the infeed line 181 to the extract cylinder 104 (104A) however upstream of the control valve HV2 at a pressure approximating that allowed on the high volume pump 179, or approximately 400 psi for example.

The output of the low volume high pressure pump 178 extends also through hydraulic control valve HV1, which preferably is a four-way valve having two operating positions In one position (as shown), the pump output is directed through the check valve 180 and hydraulic control valve HV2, and in the second position the pump output is directed through adjustable rate control valve 185 to the extend side of the indexing cylinder 66 (66A).

A solenoid SOL1 when energized shifts the valve HV1 from the position as shown against the return force of a spring; and solenoids SOL2 and SOL3 are effective to shift the extract cylinder control valve HV2, where energized solenoid SOL2 extends the extract cylinder 66 (66A) for extraction and where energized solenoid SOL3 retracts the cylinder and elevate the extract plunger 108 (108A) completely out of the tub.

There further is a pair of relief valves 186 and 187 located on the output side of the high pressure pump 178, where relief valve 186 is effective to relieve pressure over that suited for the extract cylinder, while relief valve 187 is effective to relieve pressure over that suited for the indexing cylinder.

It is noted that each disclosed embodiment utilizes a tamping device operated by cylinder 46 (46A) which is brought into the vertical tamping position by positioning cylinder 52 (52A). Each of these cylinders is preferably operated pneumatically. There secondly is provided at each extract station the extract ram 104 (104A) which preferably is a large bore high pressure hydraulic cylinder. There lastly is at the unload station an ejector cylinder 166 (166A) which preferably is pneumatically operated. The tubs 20 (or tub 20A) is indexed to the respective operating station by indexing cylinder 66 (66A). In the multiple tub embodiment, the turret is locked in place by locking cylinder 96, and this locates all the tubs. In the single tub in-line embodiment, the tub is located and locked in place by the retracting indexing cylinder 66A and the latch mechanism 80A.

In the preferred control, all power cylinders are retracted when the machine is first started, except for the latching cylinder 96 (retracting indexing cylinder 66A) which is and remains extended to hold the turret in place. Limit switches associated with the power cylinders specifically including LS1 for the eject cylinder 166 (166A), LS2 for the tamping cylinder 46 (46A), and LS3 for the extract cylinder 104 (104A) are closed only when the respective power cylinder is fully retracted and thereby are used in interlock circuits to be noted.

There normally further is provided a control switch to select the cycle sequence of the device, that is "manual" operation or "automatic" operation. There further is provided a start switch which the operator would depress and close after a tub has been loaded with wet goods at the load station.

The actuated start or "loaded" control button completes a circuit to shift air control valve PV2 to extend the power cylinder 52 (52A) and stand the tamping cylinder 46 (46A) vertically. A limit switch LS7 (LS7A) is closed as the tamping cylinder 46 (46A) reaches a vertical position and this in turn completes a circuit to shift air control valve PV3 to extend the power cylinder 46 (46A). In the preferred tamping operation, the tamping cylinder is extended into the tub with a moderate pressure against the goods therein, is then withdrawn, and is again extended and withdrawn . . . compacting the clothes in the tub while also allowing them to shift about slightly during the action. This preferred operation can be completed for example, by incorporating timers in circuit with the air control valve PV3; where the cylinder might be extended for a few seconds to compress the goods, retracted again for a few seconds, and subsequently extended and retracted until limit switch LS2 is closed at the completely retracted position. This closed limit switch LS2 in circuit electrically shifts the air control valve PV2 to retract tamping positioning cylinder 52 (52A) and move the tamping plate out of the way until it is needed for loading the next batch of wet goods. At this point also as caused by the closed limit switch LS2, the latching cylinder 96 is retracted via the air control valve PV7.

The energized limit switch LS2, sensing that the tamping cylinder has been fully retracted, also energizes solenoid SOL1 to shift the hydraulic valve HV1 to pour high pressure oil to the extend side of the hydraulic indexing cylinder 66 (66A).

In the indexing operation with the control valve HV1 shifted, the output of the high pressure pump 178 is directed through the valve HV1 and the rate valve 185 to the extend side of the indexing cylinder which extends the cylinder and indexes the tub toward the next station. The rate valve 185 controls the advance of the cylinder and as noted, the pressure buildup of the cylinder is appreciable to move the tub with a generally uniform motion.

In the multiple tub unit 10, as the tub at the extract station moves away from the station toward the unload station, the tub flange momentarily shifts limit switch LS4 which signals air control valve PV4 to port moderate air pressure to the latch cylinder 96. This moderate pressure is achieved by directing the input air line pressure through a pressure regulator which thereby allows setting any pressure desired. This moderate pressure at latch cylinder 96 allows the latch to act as a shock absorber as the next tub indexes into and past the extract position.

When the tub locking means 80 (80A) passes the extract station, LS5 (LS5A) is shifted to deenergize solenoid SOL1 of oil control valve HV1. Upon deenergization of solenoid SOL1, the control valve HV1 is spring returned to the position as shown, which thereby vents the extend side of the indexing cylinder 66 (66A) back to the reservoir, and further allows pressure buildup on the retract side of the cylinder from the output of the low pressure high volume pump 179, particularly from line 189 upstream of the dump valve 183. It is noted that in practice this line will have only approximately 60 psi during the indexing part of the cycle due only to the line resistance in the check valve 180 and valve HV2.

The retracted indexing cylinder 66 in the multiple tub unit prepares the indexing means for the subsequent cycle by passing the roller back over the trailing pawl lug; and the retracted cylinder 66A in the in-line single tub arrangement latches the tub in place at the extract station. The pressure buildup in the retracted indexing cylinder 66A can approach 400 psi for example, before the dump valve 183 is opened by pressure in the line 181 exceeding 400 psi; but drops rapidly once the dump valve is opened and the only back pressure at line 189 is that of the check valve 180.

The shifted limit switch LS5 also causes air control valve PV5 to port full line pressure through the shuttle valve to the locking cylinder 96, which in effect causes a reverse turret rotation to lock the tub flange against the set latch 82.

At this time LS6 (LS6A) should be closed, but it will be only if the latch 90 (latch bar 90A) is in its proper locking position and stopped where the tub loaded with the wet goods is at the extract position. If the latch 90 (latch bar 90A) passes the proper locating and clamping position or if the cylinder 96 (66A) is unable to reverse move the turret (tub) fully into the proper position, then the limit switch LS6 (LS6A) will not be shifted and as a safety feature the cycle is stopped until the corrective action can be taken. The review of the condition of the limit switch LS6 (LS6A) is preferably delayed a short time of for example, three to eight seconds, by a timer before beginning the extract cycle.

Thus, the extract cycle begins automatically when the limit switch LS6 (LS6A) is closed when such condition is reviewed, which energizes the solenoid SOL2 for shifting the oil control valve HV2 for porting high pressure oil to the extend side of the extract cylinder 104 (104A). The cylinder quickly is filled by both pumps 178 and 179, and pressure buildup follows with the high pressure pump 178 until the relief valve 186 is triggered. As noted, this pressure is set rather high to produce the high desired extraction forces. The output of the low pressure high volume pump 179 is bypassed through the open dump valve 183.

The extraction cycle is preferably timed for a duration of three to four minutes. The operator can use this time in the multiple tub unit to load the trailing tub now at the loading station and as before push the "loaded" control after such tub has been completely filled to begin the tamping of this next load.

After the timed interval of the extract cycle, the valve HV2 is shifted via deenergization of SOL2 and the energization of solenoid SOL3. This timed signal also shifts the air control valve PV6 to blow off any water standing on the base plate near the tub. This blowoff is terminated when the extract cylinder hits the limit switch LS3 upon its complete upward retraction.

The separable blowby air connector 154 is not needed on the single tub unit, as it is between the single source of air and the multiple tubs, so that the valve PV6 can be replaced by a simple open/close valve PV6A. The typical valve PV6 would be four-way, for both pressuring and retracting the blowby cylinder piston 156, to allow tub indexing, etc.

In the multiple tub unit, the shifted limit switch LS6 signifying the turret is locked also signals the air control valve PV1 to shift causing the eject cylinder 166 to push out the extracted goods in the tub then at the unload station. In the single tub in-line arrangement, the completed extract cycle serves to instigate the second index of the tub from the extract station to the unload station, and when the tub is at this station a limit switch LS8A is closed. A timer typically is used in each unit to retract the eject cylinder 166 (166A) after about 50 seconds.

In the in-line arrangement, the tub is indexed from the unload station back to the load station as soon as the eject cycle has been completed, and power is taken off solenoid SOL1 of the oil control valve HV1. The multiple tub unit is not indexed until the tamping on the next loaded tub is completed, even after the previous extraction cycle has been completed.

In the "manual" mode of operation, each of the tamping, indexing, extracting or unloading steps may be done by pushing a button for that operation in any order. However, typically electrical interlocks will prevent an operator from operating any of the cycles where such may damage the machine.

What is claimed is:

1. A compression extractor device for removing excess water from laundered goods, comprising a tub having pervious sides and an open top and an open bottom, means for supporting the tub for movement between and to spaced load, extract, and unload operating stations, means for indexing the tub between and to the respective stations and means for registering and holding the tub at the respective stations, means at the load station including clearance above the open tub top and a base plate underlying and closing the open tub bottom whereby goods can be loaded into the open tub top and be retained therein by the base plate, said base plate extending also in an uninterrupted manner to the extract station to allow movement of the loaded tub to the extract station while maintaining the tub bottom closed and the goods in the tub, an extractor plunger at the extract station above the open tub top and means for urging the extractor plunger downwardly against the goods in the tub and against the base plate effective for forcing excess water from the goods and out the pervious sides of the tub and onto the base plate, vent means carried by the tub adjacent the tub bottom, means effective with the tub at said extract operating station for discharging air at a high velocity from the vent means and against the base plate for blowing standing water from the base plate, and means at said unload station including clearance below the open tub bottom effective for discharging the extracted goods from the open tub bottom.

2. A compression extractor device according to claim 1, wherein the air discharging means includes a receiver on the tub communicating with the vent means, a power cylinder assembly supported at the extract operating station, means connecting a source of fluid under pressure with the power cylinder assembly, and the power cylinder assembly having a hollow rod and piston device movable upon pressurizing the power cylinder assembly into a generally sealed registry with the tub receiver when the tub is at the extract station and being operable thereafter to transmit the fluid pressure of the power cylinder assembly through the receiver for discharge from the vent means.

3. A compression extractor device for removing excess water from laundered goods, comprising a frame, a tub having pervious sides and an open top and an open bottom, means supporting the tub for movement relative to the frame between and to spaced load, extract, and unload operating stations, the frame having a base plate underlying and closing the open bottom of the tub when the latter is at the load station and at the extract station, means for supporting the tub to move vertically relative to the frame from a lower most position closely adjacent but spaced from the base plate to an upper most position spaced several inches above the base plate, spring means resiliently biasing the tub in a direction towards its upper most position, means at the load station including clearance above the open top of the tub for loading goods into the tub at said load station, means for indexing the tub between and to the respective stations whereby the loaded tub can be moved from the load station to the extract station while the base plate maintains the tub bottom closed to retain the goods in the tub, an extractor plunger at the extract station and means for urging the extractor plunger downwardly into the open top of the tub and against the goods therein for biasing them against the base plate and against each other for forcing excess water from the goods for leakage out the pervious sides of the tub and onto the base plate, support feet mounted on the tub and projecting below the normal lower edge thereof adapted to engage the base plate when the tub is at the extract station and during the descending action of the extractor plunger to define thereby the lower most position of the tub, and means at the unload station including clearance below the open tub bottom effective for discharging the extracted goods from the open tub bottom.

4. A compression extractor device according to claim 3, further including vent means carried by the tub adjacent the lower edge thereof, and means effective with the tub at the extract station for discharging air at a high velocity from the vent means and against the base plate for blowing standing water from the base plate.

5. A compression extractor device according to claim 3, wherein the tub supporting means includes spaced arms of the frame disposed adjacent different sides of the tub generally at tangent points thereof, elongated cooperating sleeve means extending in the direction of the tub axis interconnecting respectively the tub and the arms, and slide means cooperating between the tub and frame mediately between the tangent points.

6. A compression extractor device according to claim 3, wherein the tub supporting means includes rails on the tub and anti-friction means supported by the frame above the rails at the extract station, whereby engagement of the rails with the anti-friction means limits upward movement of the tub from the base plate while yet accomodates tub movement from the extract station to the unload station.

7. A compression extractor device for removing excess water from laundered goods, comprising a tub having pervious sides and an open top and an open bottom, a frame and means for supporting the tub for movement relative to the frame between and to spaced load, extract, and unload operating stations, means for indexing the tub between and to the respective stations and means for registering and holding the tub at the respective stations, said tub indexing means comprising a double acting power cylinder effective upon being pressurized on one side to shift the tub beyond the extract station in the direction of movement from the load station, means to sense that the tub has been shifted beyond the extract station and means responsive to this to vent the one side of the power cylinder and means to reverse the movement of the tub back towards the extract station, one way stop means between the frame and the tub that engage to stop the reverse movement of the tub at the exact centered alignment of the tub at the extract station, an extractor plunger at the extract station aligned with the tub thereat, and means for urging the extractor plunger against goods in the tub effective for forcing excess water from the goods and out the pervious sides of the tub.

* * * * *